US010897084B2

(12) United States Patent
Saraf

(10) Patent No.: US 10,897,084 B2
(45) Date of Patent: Jan. 19, 2021

(54) FEED FOR DUAL BAND ANTENNA

(71) Applicant: MTI WIRELESS EDGE, LTD., Rosh Ha'ayin (IL)

(72) Inventor: Israel Saraf, Beit-El (IL)

(73) Assignee: MTI WIRELESS EDGE, LTD., Rosh Ha'ayin (IL)

( * ) Notice: Subject to any disclaimer, the term of this patent is extended or adjusted under 35 U.S.C. 154(b) by 0 days.

(21) Appl. No.: 16/357,422

(22) Filed: Mar. 19, 2019

(65) Prior Publication Data

US 2019/0288394 A1 Sep. 19, 2019

(30) Foreign Application Priority Data

Mar. 19, 2018 (IL) ..... 258216

(51) Int. Cl.
*H01Q 5/47* (2015.01)
*H01Q 5/335* (2015.01)
(Continued)

(52) U.S. Cl.
CPC ..... *H01Q 5/47* (2015.01); *H01Q 5/335* (2015.01); *H01Q 5/392* (2015.01); *H01Q 19/193* (2013.01)

(58) Field of Classification Search
CPC ..... H01Q 5/47; H01Q 19/193; H01Q 5/335; H01Q 5/392; H01Q 5/45; H01P 1/161; H04B 7/18519
(Continued)

(56) References Cited

U.S. PATENT DOCUMENTS 4,442,437 A 4/1984 Chu et al.
4,785,306 A * 11/1988 Adams ..... H04B 7/18519 343/785
(Continued)

FOREIGN PATENT DOCUMENTS

WO 2016/176717 A1 11/2016

OTHER PUBLICATIONS

Adrienne C. Leifer and Walter Rotman: "Grasp: An improved displacedaxis, dual-reflector antenna design for EHF applications", Jun. 8, 1986 (Jun. 8, 1986), Retrieved from the Internet: URL:https://ieeexplore.ieee.org/document/1149656 [retrieved on Jun. 18, 2019].
(Continued)

*Primary Examiner* — Seokjin Kim
(74) *Attorney, Agent, or Firm* — Browdy and Neimark, PLLC

(57) ABSTRACT

A feed for a dual-band antenna, comprising:
a first waveguide for low frequency electromagnetic radiations,
a second dielectric waveguide for high frequency electromagnetic radiations,
an end connected to a low band port configured to pass said low frequency electromagnetic radiations, and a high band port configured to pass said high frequency electromagnetic radiations,
wherein the first waveguide comprises a first longitudinal section and a second longitudinal section,
wherein a minimal distance between an internal surface of walls of the first section and an external surface of walls of the second dielectric waveguide is $D_{11}$ along a lateral direction orthogonal to the longitudinal direction, and wherein a maximal distance between an internal surface of at least one first wall of the second section and an external surface of a wall of
(Continued)

the second dielectric waveguide facing said first wall is $D_{12}$ along said lateral direction, wherein $D_{12}<D_{11}$.

18 Claims, 11 Drawing Sheets

(51) Int. Cl.
*H01Q 5/392* (2015.01)
*H01Q 19/19* (2006.01)

(58) Field of Classification Search
USPC ..... 343/719, 773, 776, 785, 786, 854, 872, 343/873; 333/135, 106, 108, 126, 129, 333/21 R
See application file for complete search history.

(56) References Cited

U.S. PATENT DOCUMENTS

| | | | |
|---|---|---|---|
| 5,109,232 | A | 4/1992 | Monte |
| 6,323,819 | B1 | 11/2001 | Ergene |
| 6,624,792 | B1 | 9/2003 | Chu et al. |

OTHER PUBLICATIONS

L. Shafai, A. Ittipiboon, E. Bridges, and F. Hyjazie: "Dualband horn with inherent isolation between its transmit and receive ports", I EE Proceedings H—Microwaves, Optics and Antennas, vol. 131, No. 3 Jun. 1984 (Jun. 1984), pp. 143-146, Retrieved from the Internet: URL:https://ieeexplore.ieee.org/document/4646151.

* cited by examiner

FEED FOR DUAL BAND ANTENNA

TECHNICAL FIELD

The presently disclosed subject matter relates to antenna elements and to antennas.

In particular, it relates to new systems and methods for a dish antenna.

BACKGROUND

Dish antennas are antennas comprising a dish and a feed. When the antenna operates in reception, electromagnetic radiations are reflected by the dish towards the feed, which then communicates the electromagnetic radiations to corresponding port(s). Depending on the needs, the antenna can be a single feed-band antenna, or a double feed-antenna.

U.S. Pat. No. 4,785,306 constitutes background to the presently disclosed subject matter. Acknowledgement of the above reference herein is not to be inferred as meaning that this reference is in any way relevant to the patentability of the presently disclosed subject matter.

There is now a need to propose new solutions for improving the structure and operation of antenna(s), and in particular of dish antennas.

GENERAL DESCRIPTION

In accordance with certain aspects of the presently disclosed subject matter, there is provided a feed for a dual-band antenna, comprising a waveguide structure comprising a first waveguide configured to communicate first electromagnetic radiations falling in a first frequency range, wherein the first waveguide extends along a longitudinal direction, and a second dielectric waveguide located within said first waveguide, said second waveguide being configured to communicate second electromagnetic radiations, said second electromagnetic radiations falling in a second frequency range, wherein the second frequency range is higher than the first frequency range, said waveguide structure having a first end whose extremity is configured to pass both first and second electromagnetic radiations, a second end connected to a low band port configured to pass said first electromagnetic radiations, and to a high band port configured to pass said second electromagnetic radiations, wherein the first waveguide comprises a first section extending from said first end along said longitudinal direction, and a second section extending along said longitudinal direction until said second end, wherein a minimal distance between an internal surface of walls of the first section of said first waveguide and an external surface of walls of the second dielectric waveguide is $D_{11}$ along a lateral direction orthogonal to said longitudinal direction, and wherein a maximal distance between an internal surface of at least one first wall of the second section of the first waveguide and an external surface of a wall of the second dielectric waveguide facing said first wall is $D_{12}$ along said lateral direction, wherein $D_{12}<D_{11}$, wherein the waveguide structure further comprises a protrusion located at said second end.

In addition to the above features, the feed according to this aspect of the presently disclosed subject matter can optionally comprise one or more of features (i) to (vii) below, in any technically possible combination or permutation:

i. the protrusion protrudes in a direction substantially parallel to the longitudinal direction and constitutes at least part of a floor of the second end of said waveguide structure;

ii. the protrusion comprises an opening in which an extremity of the second waveguide is inserted;

iii. the protrusion comprises one or more steps;

iv. the protrusion and said first wall are orthogonal;

v. a minimal distance between the surface of said at least one first wall of the second section of the first waveguide and an external surface of a wall of the second dielectric waveguide facing said first wall is $D_{13}$ along said lateral direction, wherein $0.25*\lambda_2 \leq D_{13}$, wherein $\lambda_2$ is a maximal wavelength of the second electromagnetic radiations;

vi. the second protrusion comprises a portion extending from said at least one first wall towards the low band port along a distance $D_2$, wherein $D_2$ is less or equal to $\lambda_1$, wherein $\lambda_1$ is a central wavelength of the first electromagnetic radiations;

vii. at least one of conditions (a) and (b) is met:

(a) at least one of the walls of the first waveguide comprises a first portion and a second portion, wherein the first portion extends, in said longitudinal direction, along a height of at least $0.6\ \lambda_1$, wherein $\lambda_1$ is a central wavelength of the first electromagnetic radiations, and for each plane orthogonal to the longitudinal direction in which the first portion is present, the first portion of said wall located in said plane protrudes inwardly towards the second waveguide with respect to the second portion of said wall located in said plane;

(b) the feed comprises a quarter-wave transformer, located at an interface between said first end of said waveguide structure and a reflector of the feed, wherein a distance $D_3$ between the quarter-wave transformer and the second waveguide is such that $D_3>(\lambda_2/4)$, wherein $\lambda_2$ is a maximal wavelength of the second electromagnetic radiations.

In addition to the above features, the feed according to this aspect of the presently disclosed subject matter can optionally comprise one or more of features (viii) to (xvii) described hereinafter, in any technically possible combination or permutation.

According to another aspect of the presently disclosed subject matter there is provided a feed for a dual-band antenna, comprising a waveguide structure comprising a first waveguide configured to communicate first electromagnetic radiations falling in a first frequency range, wherein the first waveguide extends along a longitudinal direction, and a second dielectric waveguide located within said first waveguide, said second waveguide being configured to communicate second electromagnetic radiations, said second electromagnetic radiations falling in a second frequency range, wherein the second frequency range is higher than the first frequency range, said waveguide structure having a first end whose extremity is configured to pass both first and second electromagnetic radiations, a second end connected to a low band port configured to pass said first electromagnetic radiations, and a high band port configured to pass said second electromagnetic radiations, wherein the first waveguide comprises walls, wherein at least one of said walls comprises a first portion and a second portion, wherein the first portion extends, in said longitudinal direction, along a height of at least $0.6\ \lambda_1$, wherein $\lambda_1$ is a central wavelength of the first electromagnetic radiations, and for each plane orthogonal to the longitudinal direction in which the first portion is present, the first portion of said wall located in said plane protrudes inwardly towards the second waveguide with respect to the second portion of said wall located in said plane.

In addition to the above features, the feed according to this aspect of the presently disclosed subject matter can optionally comprise one or more of features (viii) to (xiv) below, in any technically possible combination or permutation:

viii. said first portion extends along said height from a top wall of a structure of the low band port which is connected to the first waveguide, or the first waveguide comprises a first section extending from said first end along said longitudinal direction, and a second section extending along said longitudinal direction until said second end, wherein a minimal distance between an internal surface of walls of the first section of said first waveguide and an external surface of walls of the second dielectric waveguide is $D_{11}$ along a lateral direction orthogonal to said longitudinal direction, wherein a maximal distance between an internal surface of at least one first wall of the second section of the first waveguide and an external surface of a wall of the second dielectric waveguide facing said first wall is $D_{12}$ along said lateral direction, wherein $D_{12}<D_{11}$, wherein said first portion extends along said height from an interface between said first section and said second section;

ix. each of at least two walls of said first waveguide, or each of at least three walls of said first waveguide, or each of four walls of said first waveguide comprises a first portion and a second portion, wherein the first portion extends, in said longitudinal direction, along a height of at least 0.6 $\lambda_1$, wherein $\lambda_1$ is a central wavelength of the first electromagnetic radiations, and for each plane orthogonal to the longitudinal direction in which the first portion is present, the first portion of said wall located in said plane protrudes inwardly towards the second waveguide with respect to the second portion of said wall located in said plane;

x. said first portion extends along said height from a top wall of a structure of the low band port which is connected to the first waveguide, or the first waveguide comprises a first section extending from said first end along said longitudinal direction, and a second section extending along said longitudinal direction until said second end, wherein a minimal distance between an internal surface of walls of the first section of said first waveguide and an external surface of walls of the second dielectric waveguide is $D_{11}$ along a lateral direction orthogonal to said longitudinal direction, wherein a maximal distance between an internal surface of at least one first wall of the second section of the first waveguide and an external surface of a wall of the second dielectric waveguide facing said first wall is $D_{12}$ g along said lateral direction, wherein $D_{12}<D_{11}$, wherein said first portion extends along said height from an interface between said first section and said second section;

xi. each of at least two walls of said first waveguide, or each of at least three walls of said first waveguide, or each of four walls of said first waveguide comprises a first portion and a second portion, wherein the first portion extends, in said longitudinal direction, along a height of at least 0.6 $\lambda_1$, wherein $\lambda_1$ is a central wavelength of the first electromagnetic radiations, and for each plane orthogonal to the longitudinal direction in which the first portion is present, the first portion of said wall located in said plane protrudes inwardly towards the second waveguide with respect to the second portion of said wall located in said plane;

xii. said first portion delimits a cavity manufactured in said wall;

xiii. a shape of a cross-section of said first portion in said plane is one of a rectangle, a triangle, a portion of a circle, and a line;

xiv. at least one of conditions (a) and (b) is met:

(a) the first waveguide comprises a first section extending from said first end along said longitudinal direction, and a second section extending along said longitudinal direction until said second end, wherein a minimal distance between an internal surface of walls of the first section of said first waveguide and an external surface of walls of the second dielectric waveguide is $D_{11}$ along a lateral direction orthogonal to said longitudinal direction, and wherein a maximal distance between an internal surface of at least one first wall of the second section of the first waveguide and an external surface of a wall of the second dielectric waveguide facing said first wall is $D_{12}$ along said lateral direction, wherein $D_{12}<D_{11}$, wherein the waveguide structure further comprises a protrusion located at said second end;

(b) the feed comprises a quarter-wave transformer, located at an interface between said first end of said waveguide structure and a reflector of the feed, wherein a distance $D_3$ between the quarter-wave transformer and the second waveguide is such that $D_3>(\lambda_2/4)$, wherein $\lambda_2$ is a maximal wavelength of the second electromagnetic radiations.

In addition to the above features, the feed according to this aspect of the presently disclosed subject matter can optionally comprise one or more of features (i) to (vii) described above, in any technically possible combination or permutation.

According to another aspect of the presently disclosed subject matter there is provided a feed for a dual-band antenna, comprising a waveguide structure comprising a first waveguide configured to communicate first electromagnetic radiations falling in a first frequency range, and a second dielectric waveguide located within said first waveguide, said second waveguide being configured to communicate second electromagnetic radiations, said second electromagnetic radiations falling in a second frequency range, wherein the second frequency range is higher than the first frequency range, said waveguide structure having a first end whose extremity is configured to pass both first and second electromagnetic radiations, a second end connected to a low band port configured to pass said first electromagnetic radiations, and to a high band port configured to pass said second electromagnetic radiations, a quarter-wave transformer, located at an interface between said first end of said waveguide structure and a reflector of the feed, wherein a distance $D_3$ between the quarter-wave transformer and the second waveguide is such that $D_3>(\lambda_2/4)$, wherein $\lambda_2$ is a maximal wavelength of the second electromagnetic radiations.

In addition to the above features, the feed according to this aspect of the presently disclosed subject matter can optionally comprise one or more of features (xv) to (xvii) below, in any technically possible combination or permutation:

xv. a position of a phase center of the first electromagnetic radiations and a position of a phase center of the second electromagnetic radiations substantially match along at least one axis;

xvi. a height $H_4$ of the quarter-wave transformer is equal to $\lambda_1/4$;

xvii. at least one of conditions (a) and (b) is met:

a) the first waveguide comprises a first section extending from said first end along said longitudinal direction, and a second section extending along said longitudinal direction until said second end, wherein a minimal distance between an internal surface of walls of the first section of said first waveguide and an external surface of walls of the second dielectric waveguide is $D_{11}$ along a lateral direction orthogonal to said longitudinal direction, and wherein a maximal distance between a surface of at least one first wall of the second section of the first waveguide and an external surface of a wall of the second dielectric waveguide facing said first wall is $D_{12}$ along said lateral direction, wherein $D_{12}<D_{11}$, wherein the waveguide structure further comprises a protrusion located at said second end; and (b) at least one of the walls of the first waveguide comprises a first portion and a second portion, wherein the first portion extends, in said longitudinal direction, along a height of at least 0.6 $\lambda_1$, wherein $\lambda_1$ is a central wavelength of the first electromagnetic radiations, and for each plane orthogonal to the longitudinal direction in which the first portion is present, the first portion of said wall located in said plane protrudes inwardly towards the second waveguide with respect to the second portion of said wall located in said plane.

In addition to the above features, the feed according to this aspect of the presently disclosed subject matter can optionally comprise one or more of features (i) to (xiv) above, in any technically possible combination or permutation.

According to another aspect of the presently disclosed subject matter there is provided a dual-band antenna, comprising a dish, configured to reflect at least first and second electromagnetic radiations towards a feed or transmitted by a feed, wherein said feed is in accordance with any of the embodiments described above.

According to another aspect of the presently disclosed subject matter there is provided a method of operating an antenna, said antenna comprising a first waveguide and a second dielectric waveguide located within said first waveguide, the first waveguide comprising a first end and a second end, said second end comprising a protrusion, wherein the first waveguide comprises a first section extending from said first end along said longitudinal direction, and a second section extending along said longitudinal direction until said second end, wherein a minimal distance between an internal surface of walls of the first section of said first waveguide and an external surface of walls of the second dielectric waveguide is $D_{11}$ along a lateral direction orthogonal to said longitudinal direction, and wherein a maximal distance between a surface of at least one first wall of the second section of the first waveguide and an external surface of a wall of the second dielectric waveguide facing said first wall is $D_{12}$ along said lateral direction, wherein $D_{12}<D_{11}$, wherein a minimal distance between the surface of said at least one first wall of the second section of the first waveguide and an external surface of a wall of the second dielectric waveguide facing said first wall is $D_{13}$ along said lateral direction, wherein $0.25*\lambda_2 \leq D_{13}$, wherein $\lambda_2$ is a maximal wavelength of the second electromagnetic radiations, the method comprising at least one of:

transmitting first electromagnetic radiations from a low band port of the antenna to the second end of the first waveguide, and then to a reflector which reflects the first electromagnetic radiations for their transmission, second electromagnetic radiations, falling in a higher frequency range than the first electromagnetic radiations, from a high band port of the antenna to the second dielectric waveguide, and then to the reflector which reflects the second electromagnetic radiations for their transmission, receiving first electromagnetic radiations and second electromagnetic radiations, wherein said second electromagnetic radiations fall in a higher frequency range than the first electromagnetic radiations, passing the first electromagnetic radiations from the first end of the first waveguide to the second end of the first waveguide, and then to a low band port of the antenna, and communicating the second electromagnetic radiations through the second waveguide towards the high band port of the antenna.

According to some embodiments, at least one of conditions (a) and (b) is met for said antenna:

(a) at least one of the walls of the first waveguide comprises a first portion and a second portion, wherein the first portion extends, in said longitudinal direction, along a height of at least 0.6 $\lambda_1$, wherein $\lambda_1$ is a central wavelength of the first electromagnetic radiations, and for each plane orthogonal to the longitudinal direction in which the first portion is present, the first portion of said wall located in said plane protrudes inwardly towards the second waveguide with respect to the second portion of said wall located in said plane;

(b) the feed comprises a quarter-wave transformer, located at an interface between said first end and a reflector of the antenna, wherein a distance $D_3$ between the quarter-wave transformer and the second waveguide is such that $D_3>(\lambda_2/4)$, wherein $\lambda_2$ is a maximal wavelength of the second electromagnetic radiations.

In addition to the above features, the antenna according to this aspect of the presently disclosed subject matter can optionally comprise a feed comprising one or more of features (i) to (xvii) above, in any technically possible combination or permutation.

According to some embodiments, the proposed solution provides an antenna which is operative in at least two different frequency ranges (high band signal and low band signal).

According to some embodiments, the proposed solution provides an antenna which is operative in at least two different frequency ranges, wherein these two different frequency ranges can be close one to the other.

According to some embodiments, the proposed solution provides a double feed antenna in which the return loss is reduced, in particular for low band frequency.

According to some embodiments, return loss of the low band signal is reduced without harming the high band signal.

According to some embodiments, the proposed solution provides a double feed antenna in which coupling between a low band port and a high band port of the antenna is reduced.

According to some embodiments, the proposed solution provides a double feed antenna in which at least one electromagnetic mode, which can introduce perturbations in the low band signal, is reduced or removed.

According to some embodiments, the proposed solution provides a double feed antenna in which transmission of the high band and low band signals, from a waveguide to a sub-reflector of the feed, is improved. In particular, return loss and undesired scattering of the signals are reduced.

According to some embodiments, the proposed solution provides a double feed antenna in which the phase center of the low band signal and the phase center of the high band signal are located at substantially the same position. As a consequence, performance of the antenna is improved.

BRIEF DESCRIPTION OF THE DRAWINGS

In order to understand the invention and to see how it can be carried out in practice, embodiments will be described, by way of non-limiting examples, with reference to the accompanying drawings, in which.

DETAILED DESCRIPTION

In the following detailed description, numerous specific details are set forth in order to provide a thorough understanding of the invention. However, it will be understood by those skilled in the art that the presently disclosed subject matter may be practiced without these specific details. In other instances, well-known methods have not been described in detail so as not to obscure the presently disclosed subject matter.

Figure 1:
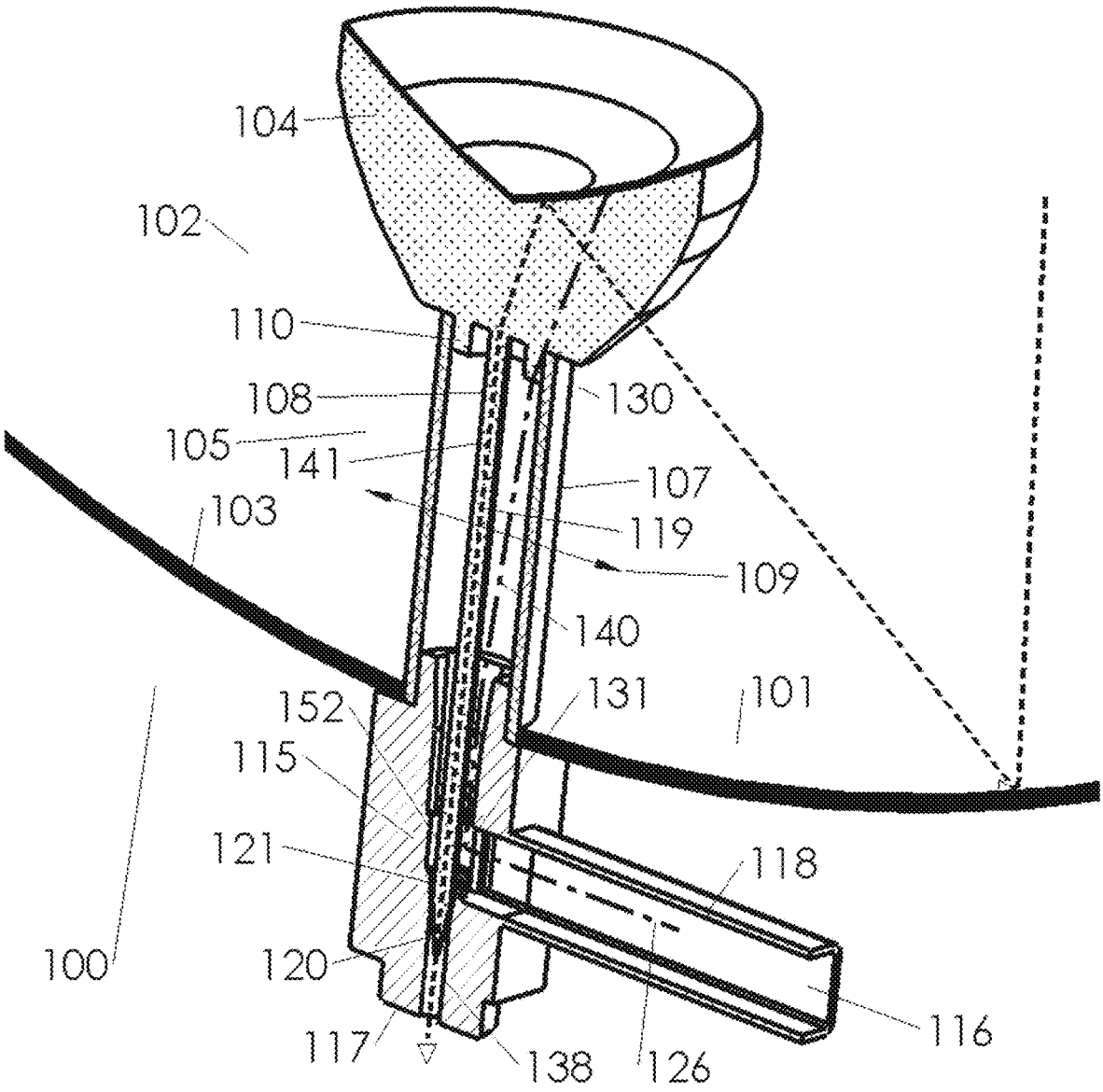
FIG. 1 illustrates an embodiment of an antenna.

FIG. 1 illustrates an antenna 100. This antenna is a "dish antenna". As shown, the antenna 100 comprises a dish 101 and a feed 102.

The dish 101 can comprise e.g. a curved surface 103 for reflecting electromagnetic radiations. In particular, when the antenna 100 operates in reception, the dish 101 can concentrate the electromagnetic radiations at its focus, at which at least part of the feed 102 can be located.

The feed 102 can comprise a reflector 104 (also called a sub-reflector) and a waveguide structure 105. The waveguide structure 105 extends along a main axis, which is called hereafter longitudinal axis 119. An axis orthogonal to the longitudinal axis 119 is called herein after lateral axis 109.

The waveguide structure 105 comprises a first waveguide 107 and a second waveguide 108 located within said first waveguide 107.

Thus, the first waveguide 107 corresponds to an external waveguide and the second waveguide 108 corresponds to an internal waveguide.

The second waveguide 108 has a thickness which is lower than the thickness of the first waveguide 107.

According to some embodiments, both the first and the second waveguides 107, 108 extend along the longitudinal axis 119.

According to some embodiments, the second waveguide 108 comprises a rod which is located within the first waveguide 107. In particular, the rod can be made of dielectric material, such as plastic.

The waveguide structure 105 can have a first end 110 whose extremity communicates with the reflector 104. The interface between the extremity of the first end 110 of the waveguide structure 105 and the reflector 104 is called a dual band port 130, through which at least first and second electromagnetic radiations are passed. In particular, first electromagnetic radiations falling in a first frequency range, and second electromagnetic radiations falling in a second frequency range, wherein the second frequency range is higher than the first frequency range, can be passed through the dual band port 130.

A second end 115 of the waveguide structure 105 is connected (through a direct connection, or an indirect connection) to a low band port 116 and to a high band port 117. A junction between the waveguide structure 105 and the low band and high band ports 116, 117 is thus present at this second end 115.

The low band port 116 is configured to receive or to transmit the first electromagnetic radiations mentioned above.

The high band port 117 is configured to receive or to transmit the second electromagnetic radiations mentioned above.

According to some embodiments, the high band port 117 is located on the longitudinal axis 119. As shown, the high band port 117 can comprise a structure 138, which can be viewed as a portion of a waveguide, and which can have various shapes.

According to some embodiments, an extremity 120 of the second waveguide 108 protrudes inside the high band port 117.

In particular, the waveguide structure 105 can comprise, at its second end 115 (in particular at the extremity of this second end 115), a bottom (which can constitute at least part of the bottom or floor of the first waveguide 107), in which a first opening or through-hole 121 is present. The extremity 120 of the second waveguide 108 can protrude through this first opening 121, and through a portion of the high band port 117.

According to some embodiments, the low band port 116 is not located on the longitudinal axis 119, but on a second axis 126 which is not parallel to the longitudinal axis 119. Thus, at the second end 115 of the waveguide structure 105, a bending is present, due to the fact that the low band port is inclined with respect to the dual band port 130.

In the embodiment of FIG. 1, the low band port 116 is located on a second axis 126 which is orthogonal to the longitudinal axis 119 (and thus parallel to axis 109). In this case, a "T" junction is present at the second end 115.

This is however not mandatory, and other inclinations between the longitudinal axis 119 and the second axis 126 can be present.

The low band port 116 can be located at the end of a structure 118 (which can be viewed as a portion of a waveguide and which can have various shapes), or can comprise this structure 118. The structure 118 extends along the second axis 126. One end of the structure 118 is connected to an opening 131 located in at least one wall of the first waveguide 107, thus allowing communication of electromagnetic signals between the low band port 116 and the first waveguide 107.

When the antenna 100 operates in reception (the arrows in FIG. 1 illustrate the antenna 100 when it operates in reception), electromagnetic signals 140 are collected by the dish 101. As mentioned above, these electromagnetic signals 140 can comprise first electromagnetic radiations falling in a first frequency range, and second electromagnetic radiations falling in a second frequency range, wherein the second frequency range is higher than the first frequency range.

Non limitative examples of these ranges are as follows:

- the first frequency range is in the C Band (e.g. 4 GHz) and the second frequency range is in the Ku Band (e.g. 12 GHz);
- the first frequency range is in a band of around 18 GHz and the second frequency range is in a band of around 80 GHz.

Both the first and second electromagnetic signals are reflected by the dish 101 towards the feed 102. In particular, they are reflected towards the reflector 104 of the feed 102, which reflect these signals towards the dual band port 130. In some embodiments, and as mentioned later in the specification, an impedance transformer can be located at the dual band port 130.

At the dual band port 130, the first electromagnetic signals 140 enter the first waveguide 107 and the second electromagnetic signals 141 enter the second waveguide 108.

The first electromagnetic signals 140 propagate within the first waveguide 107 along the longitudinal axis 119, until they escape the first waveguide 107 through the opening 131 and the structure 118, in order to reach the low band port 116. According to some embodiments, the first electromagnetic signals 140 are then communicated to a low band RX/TX instrument.

The second electromagnetic signals 141 propagate within the second waveguide 108 along the longitudinal axis 119, in order to reach the high band port 117. According to some embodiments, the second electromagnetic signals 141 are then communicated to a high band RX/TX instrument.

When the antenna operates in transmission, the propagation is performed the other way round. In particular, according to some embodiments:

- the first electromagnetic signals propagate from the low band port through the first waveguide, through the dual band port, and are reflected by the reflector and then by the dish (as mentioned, in some embodiments, an impedance transformer is located at the dual band port); and
- the second electromagnetic signals propagate from the high band port through the second waveguide, through the dual band port, and are reflected by the reflector and then by the dish.

According to some embodiments, the antenna 100 can receive and transmit electromagnetic radiations (that is to say at least the first and second electromagnetic radiations) at the same time.

A method of operation of the antenna 100 can thus comprise:

transmitting:

- first electromagnetic radiations from the low band port to the first waveguide and then to the reflector which reflects the first electromagnetic radiations toward the dish, and
- second electromagnetic radiations from the high band port to the second waveguide, and then to the reflector which reflects the second electromagnetic radiations toward the dish, receiving:

- first electromagnetic radiations and second electromagnetic radiations by the dish which reflects them towards the feed,
- communicating the first electromagnetic radiations through the first waveguide towards the low band port, and
- communicating the second electromagnetic radiations through the second waveguide towards the high band port.

The antenna 100 used in this method can be in compliance with any of the embodiments described below.

Attention is now drawn to FIGS. 2 and 2A to 2C.

According to some embodiments, the first waveguide 107 comprises a first section 112 extending from the first end 110 along the longitudinal direction 119, and a second section 113 extending along the longitudinal direction 119 from an extremity of said first end 110 until said second end 115 (in particular until the extremity of said second end 115). Thus, the first waveguide 107 can be divided, in the longitudinal direction 119, as comprising at least a first section 112 and a second section 113.

According to some embodiments, a minimal distance between an internal surface 150 of walls of the first section 112 of the first waveguide and an external surface 151 of walls of the second dielectric waveguide is $D_{11}$ along the lateral direction 109 orthogonal to the longitudinal direction 119.

A maximal distance (measured along the lateral direction 109) between an internal surface of at least one first wall 152 of the second section 113 of the first waveguide and an external surface 153 of a wall of the second dielectric waveguide facing said first wall is $D_{12}$.

According to some embodiments, $D_{12}<D_{11}$.

Figure 2:
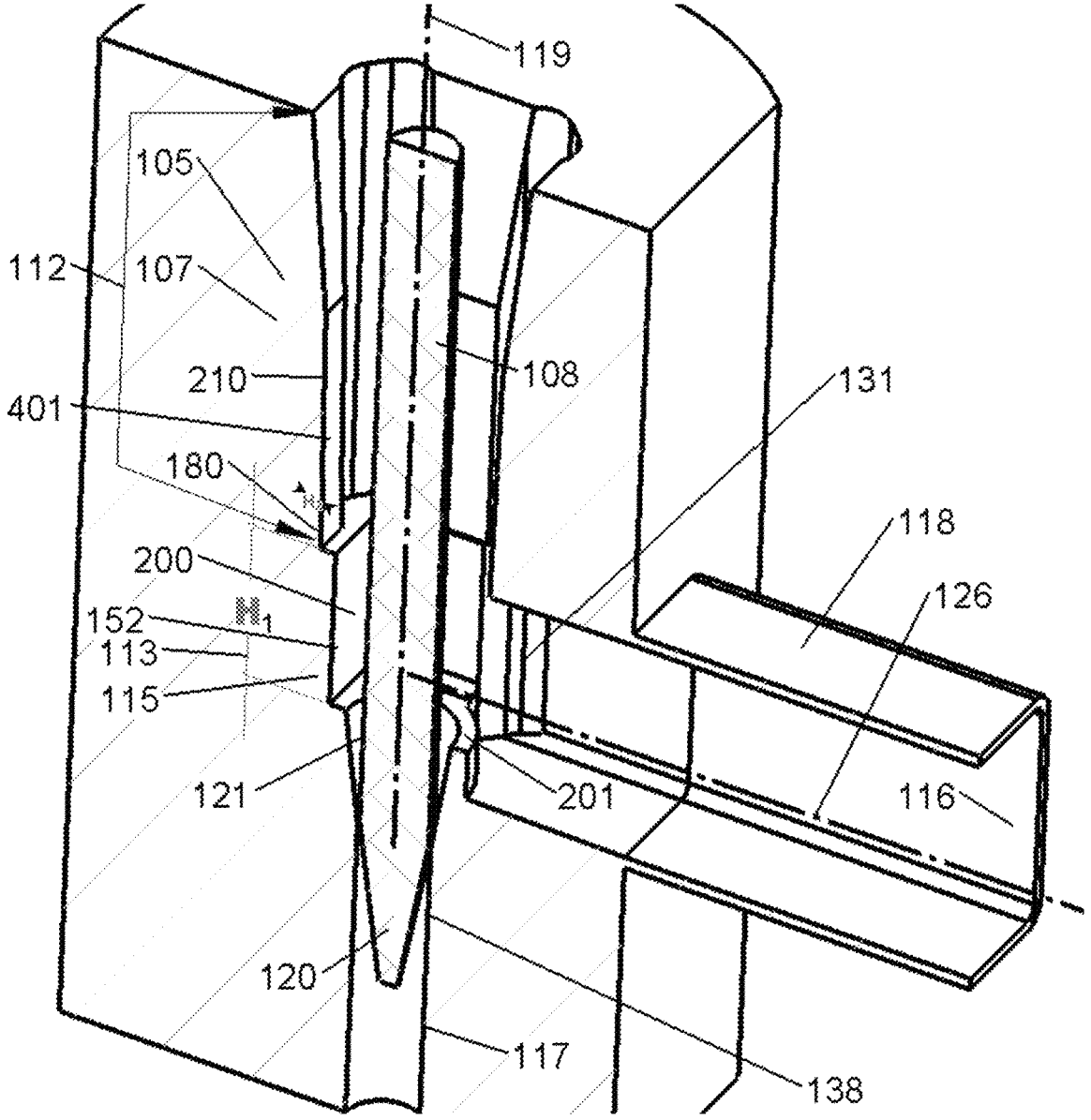
FIGS. 2 and 2A illustrate an embodiment of a feed.
Figure 2A:
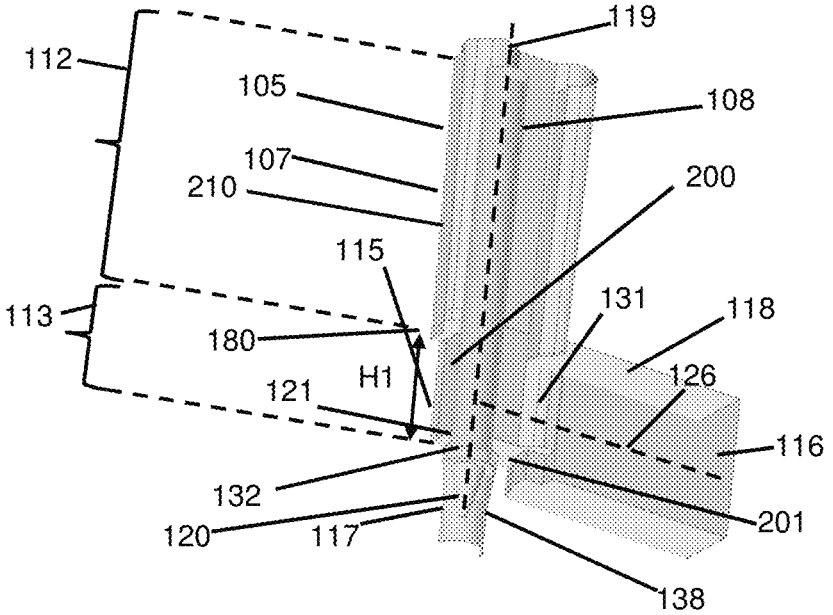

According to some embodiments, the first wall 152 of the second section 113 (at which the distance with respect to the second waveguide is reduced with respect to the first section) is the wall which is opposite to the opening 131 (that is to say that the wall is facing the opening 131 and is located opposite to it), as illustrated in FIGS. 1, 2 and 2A.

The second section 113 of the first waveguide 107, at which the distance between the walls of the first waveguide 107 and the walls of the second waveguide 108 is reduced, can be obtained in different ways.

According to some embodiments, a portion of material (first protrusion 200) is secured to the internal surface of at least one wall of the second section 113 of the first waveguide 107.

Alternatively, at least one wall 152 of the second section 113 of the first waveguide 107 can be manufactured so as to comprise an edge or a step which protrudes inwardly with respect to the first section 112 (for example, a stepped wall can be manufactured). Thus, a step can be present in the wall of the first waveguide, at the interface between the first section 112 and the second section 113.

Figure 2B:
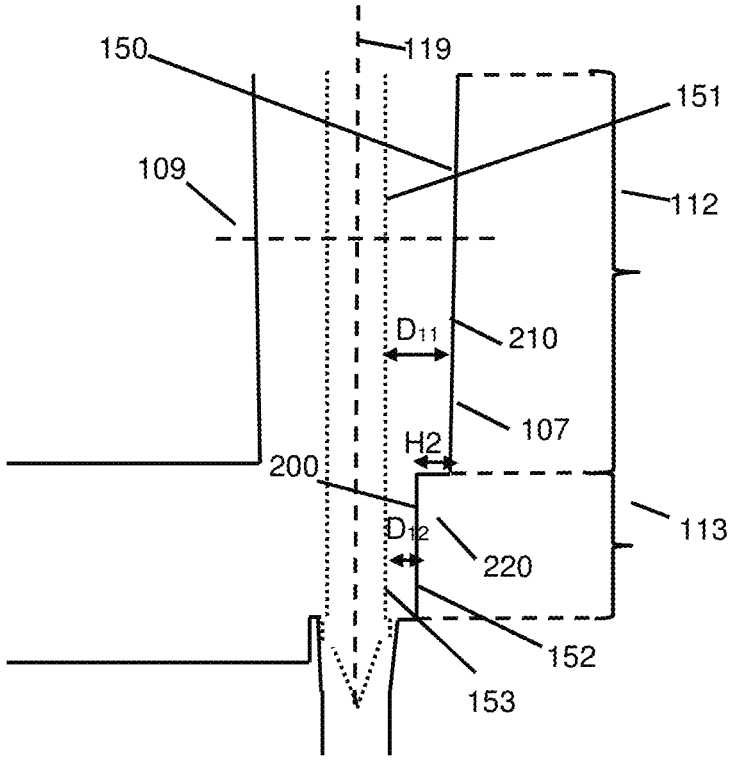
FIG. 2B illustrates a non-limitative example of a cross-sectional view of a feed.

FIG. 2B shows a non-limitative example in which the section 113 is obtained by manufacturing a wall 152 which protrudes inwardly with respect to the wall 210 (which is located at the same side of the waveguide than the wall 152) of the first section 112.

As shown, the wall 152 delimits a cavity 220. A step is present in the wall of the first waveguide 107, at the interface between the first section 112 and the second section 113.

Figure 2C:
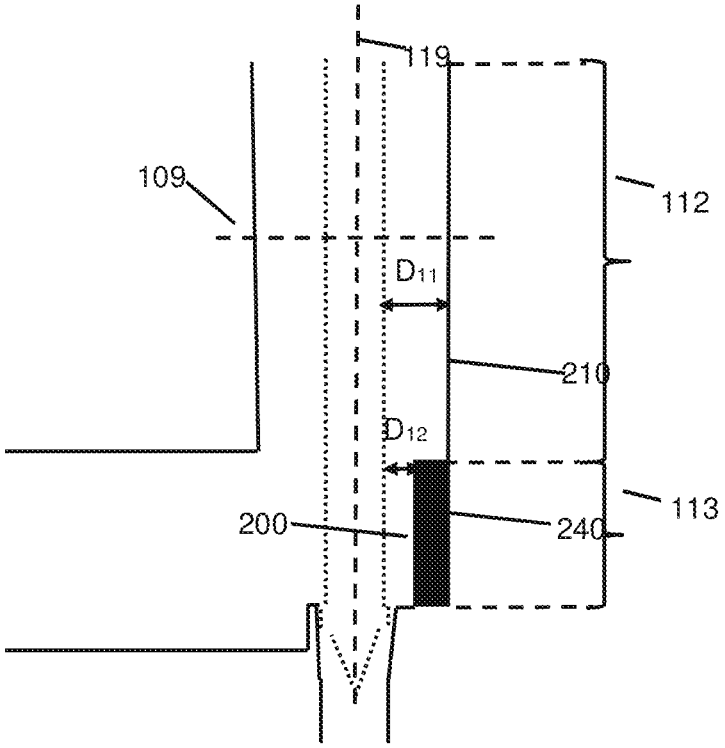
FIG. 2C illustrates another non-limitative example of a cross-sectional view of a feed.

FIG. 2C shows a non-limitative example in which a first protrusion 200 is manufactured by using a piece of material 240 which is affixed or secured to the wall 152 of the second section 113 and protrudes inwardly. The internal surface of the first protrusion 200 thus constitutes the internal surface of wall 152. As shown, the first protrusion 200 can extend in a direction parallel to the longitudinal axis 119 (that is to say that the longest dimension of the first protrusion extends in a direction parallel to the longitudinal axis 119).

In this case, no cavity is present, that it to say that the external surface of wall 152 of the second section 113 is substantially continuous with the external surface of wall 210 of the first section 112 (along the longitudinal axis 119).

According to some embodiments, the second section 113 can extend along a height $H_1$ (measured along longitudinal axis 119). This is visible in FIGS. 2A and 3A.

According to some embodiments, $H_1$ is in the range $[0.3\ \lambda_1 - 1.0\ \lambda_2]$, wherein $\lambda_1$ is a central wavelength of the first electromagnetic radiations. Indeed, the feed and the first waveguide are generally operative for a given bandwidth of the first electromagnetic radiations (also called operation bandwidth). This given bandwidth can be written as a range $[\lambda_{min,\ first\ radiations};\ \lambda_{max,\ first\ radiations}]$, wherein $\lambda_{max,\ first\ radiations}$ corresponds to the maximal wavelength of the first electromagnetic radiations and $\lambda_{min,\ first\ radiations}$ corresponds to the minimal wavelength of the first electromagnetic radiations.

The central wavelength $\lambda_1$ is generally defined as $\lambda_1 = (\lambda_{max,\ first\ radiations} + \lambda_{min,\ first\ radiations})/2$.

In the embodiment of FIG. 2A, the second section 113 extends from an extremity of the first waveguide 107 (that it so say the extremity of the second end 115, which corresponds to the position of a second protrusion 201 described hereinafter) along a height $H_1$.

As mentioned above, according to some embodiments, $H_1$ can be e.g. in the range $[0.3\ \lambda_1 - 1.0\ \lambda_1)]$.

Figure 3A:
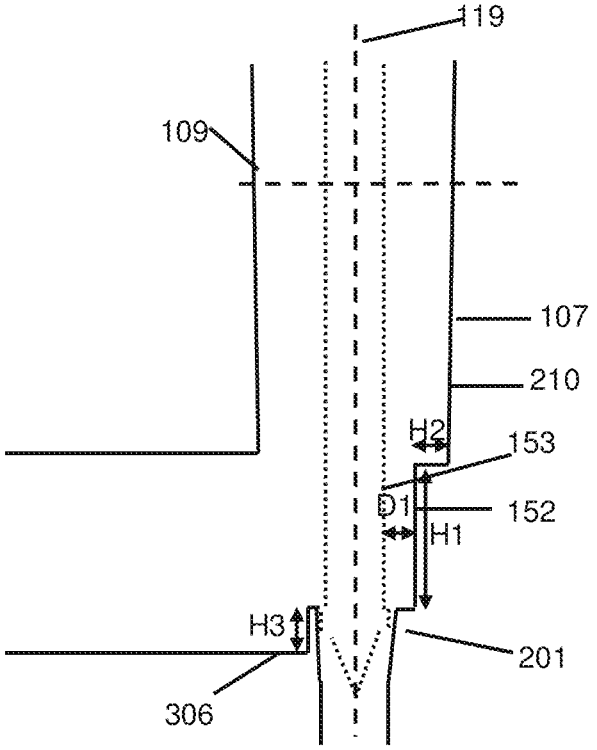
FIG. 3A illustrates a cross-sectional view of an embodiment of a feed.

In addition, and as visible in FIGS. 2 and 3A, a distance between the internal surface of the protruding wall 152 of the second section 113 and the internal surface of the wall 210 of the first section 112 which does not protrude inwardly (or protrudes less), measured along the lateral direction 109, is $H_2$ (see FIGS. 2A and 3A). As a consequence, the space available between the walls of the first waveguide 107 and the walls of the second waveguide 108 is reduced at the location of the second section 113.

In FIGS. 2A and 3A, $H_2$ is constant. However, according to some embodiments, $H_2$ can vary. In other words, if "Y" corresponds to the position measured along the longitudinal axis 119, this means that $H_2(Y)$ can be a variable function. In this case, the internal surface of the wall 152 of the second section 113 is not necessarily parallel to the longitudinal axis 119.

If "Z" is a direction measured along a direction orthogonal to both axis 119 and axis 109, according to some embodiments, $H_2(Z)$ can be a variable function (this is e.g. visible in FIG. 2A). This can be due to the fact that the wall 210 of the first section 112 can comprise itself protruding portions, as explained later in the embodiments of FIGS. 4 and 5.

According to some embodiments, a minimal distance (measured along the lateral direction 109) between an internal surface of at least one first wall 152 of the second section 113 of the first waveguide and an external surface 153 of a wall of the second dielectric waveguide facing said first wall is $D_1$ (see FIG. 3A). According to some embodiments, if $H_2(Y)$ is a varying function, $D_1$ corresponds to the absolute minimal distance along the total height $H_1$ of the second section 113.

In FIGS. 2 and 3, $D_1$ is equal to $D_{12}$ since the internal surface of the wall 152 and the external surface 153 of the wall of the second dielectric waveguide 108 facing said first wall extend in a direction substantially parallel to the longitudinal direction 119. In some embodiments in which these conditions are not met, $D_1$ can be different from $D_{12}$.

According to some embodiments, $0.25*\lambda_2 \leq D_1$, wherein $\lambda_2$ is a maximal wavelength of the second electromagnetic radiations.

Indeed, the feed and the second waveguide are generally operative for a given bandwidth of the second electromagnetic radiations (also called operation bandwidth). This given bandwidth can be written as a range $[\lambda_{min,\ second\ radiations};\ \lambda_{max,\ second\ radiations}]$, wherein $\lambda_{max,\ second\ radiations}$ corresponds to the maximal wavelength of the second electromagnetic radiations and $\lambda_{min,\ second\ radiations}$ corresponds to the minimal wavelength of the second electromagnetic radiations. Thus, $\lambda_2 = \lambda_{max,\ second\ radiations}$.

In particular, this minimal distance $D_1$ can help preventing the first protrusion 200 from interfering with the second electromagnetic signals propagating within the second waveguide 108.

According to some embodiments, the feed 102 can comprise a second protrusion 201 located at the second end 115 of the waveguide structure 105. This is visible e.g. in FIGS. 2A, 3A and 3B.

According to some embodiments, the second protrusion 201 can protrude inwardly into the first waveguide 107.

According to some embodiments, the second protrusion 201 can protrude in a direction substantially parallel to the longitudinal direction 119.

In the embodiments of FIGS. 2A to 2C, 3A and 3B, the second protrusion 201 and the internal surface of the wall 152 of the second section 113 are orthogonal. Thus, the protruding wall 152 and the wall 152 of the second section 113 protrude in directions which are orthogonal. This is however not mandatory, and according to some embodiments, an angle between the second protrusion 201 and the internal surface of the wall 152 of the second section 113 is different from 90 degrees.

According to some embodiments, the second protrusion 201 constitutes at least part of the bottom (or floor) of the waveguide structure 105, and in particular, of the first waveguide 107.

According to some embodiments, the second protrusion 201 comprises an opening or through-hole 121 in which an extremity 120 of the second waveguide 108 is inserted.

According to some embodiments, the second protrusion 201 comprises one or more steps. In particular, the second protrusion 201 can comprises a step which constitutes at least part of the bottom (or in some embodiments, the whole bottom) of the first waveguide 107.

Figure 3B:
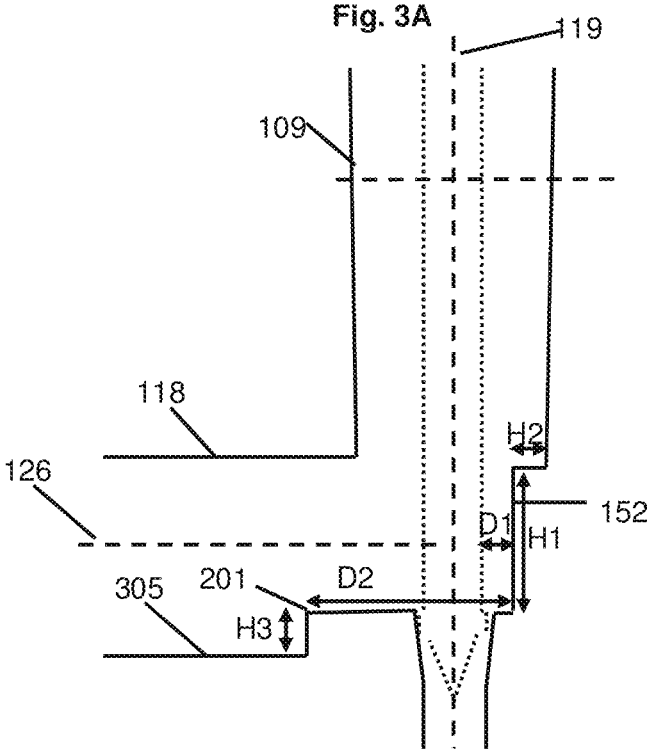
FIG. 3B illustrates a cross-sectional view of another embodiment of a feed.

According to some embodiments, the second protrusion 201 has an height $H_3$ (which can be measured along axis 119). $H_3$ can be measured as following:

if the second protrusion 201 corresponds to the whole bottom of the first waveguide 107, $H_3$ can be measured between a wall 305 (which can be also a bottom) of the structure 118 and the protruding part of the second protrusion 201 (see FIG. 3B);

if the second protrusion 201 corresponds to only part of the bottom of the waveguide structure 105, $H_3$ can be measured between the bottom 306 (at which the second protrusion 201 is not present) of the first waveguide 107 and the protruding part of the second protrusion 201 (see FIG. 3A).

If X is the position along the lateral direction 109, $H_3(X)$ is not necessarily a constant function.

According to some embodiments, the second protrusion 201 extends from the internal surface of the wall 152 of the second section 113 towards the structure 118 and the low band port 116 (e.g. in a direction parallel to axis 126, which, in some embodiments, is parallel to the lateral axis 109) along a distance $D_2$ (see FIG. 3B). If the second protrusion 201 is a step, $D_2$ can be viewed e.g. as the length of the upper portion of this step, measured from the internal surface of the wall 152 towards the low band port 116 (see illustration in FIG. 3B), e.g. along axis 126.

According to some embodiments, $D_2$ is selected to be less or equal to $\lambda_1$, wherein $\lambda_1$ is a central wavelength of the first electromagnetic radiations.

According to some embodiments, the feed 102 comprises more than two protrusions.

The protruding wall 152 of the second section 113 and the second protrusion 201 are particularly useful for reducing the return loss of the signals (in particular of the first electromagnetic radiations) that are communicated (in reception and/or transmission), in particular through the low band port 116.

Figure 7A:
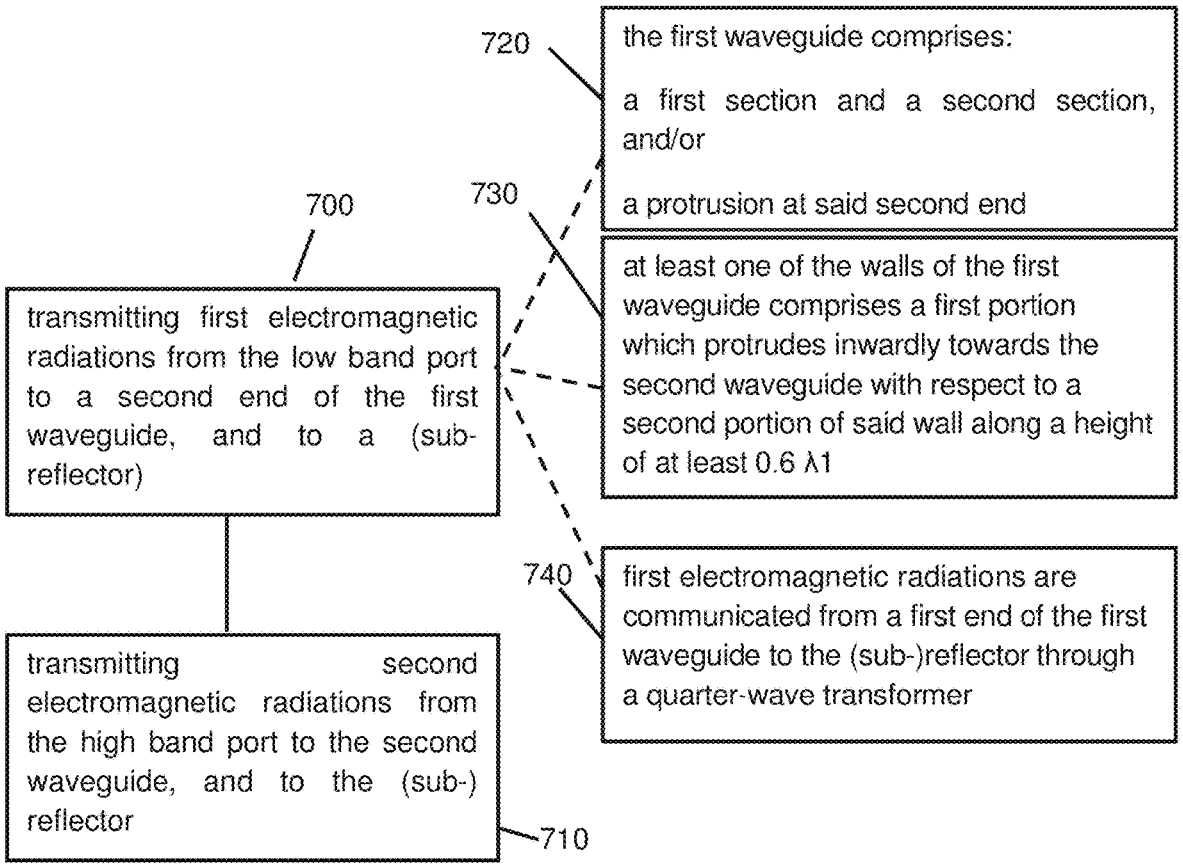
FIGS. 7A and 7B illustrate respectively a method of transmitting and receiving electromagnetic signals using an antenna comprising a feed according to some embodiments described in the specification.
Figure 7B:
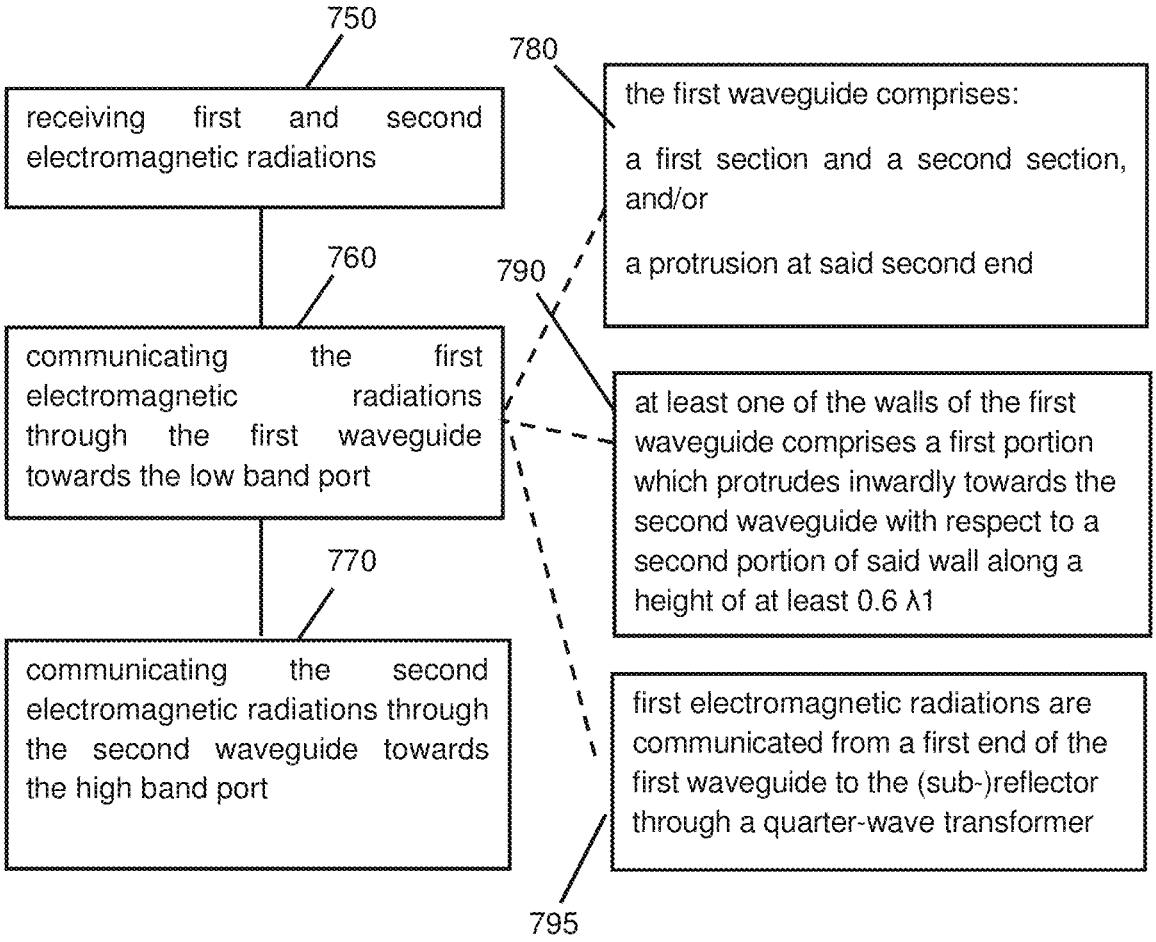

A method of operation of the antenna 100 described with reference to FIGS. 2 and 3 can thus comprises at least one of:

transmitting:

first electromagnetic radiations from the low band port to a second end of the first waveguide, wherein the first waveguide comprises a first section 112 and a second section 113 (as described above) and/or at least one second protrusion 201 (as described above), and then to the reflector which reflects the first electromagnetic radiations, such as towards the dish (see references 700 and 720 in FIG. 7A), and second electromagnetic radiations (which are in a higher frequency range than the first electromagnetic radiations) from the high band port to the second waveguide, and then to the reflector which reflects the second electromagnetic radiations, such as towards the dish (see reference 710 in FIG. 7A);

receiving:

first electromagnetic radiations and second electromagnetic radiations by the dish which reflects them towards the feed (see reference 750 in FIG. 7B);

passing the first electromagnetic radiations from a first end of the first waveguide to a second end of the first waveguide, wherein the first waveguide comprises a first section 112 and a second section 113 (as described above) and/or at least one second protrusion 201 (as described above), and then communicating the first electromagnetic radiations towards the low band port (see references 760 and 780 in FIG. 7B), and communicating the second electromagnetic radiations through the second waveguide towards the high band port (see reference 770 in FIG. 7B).

Figure 4:
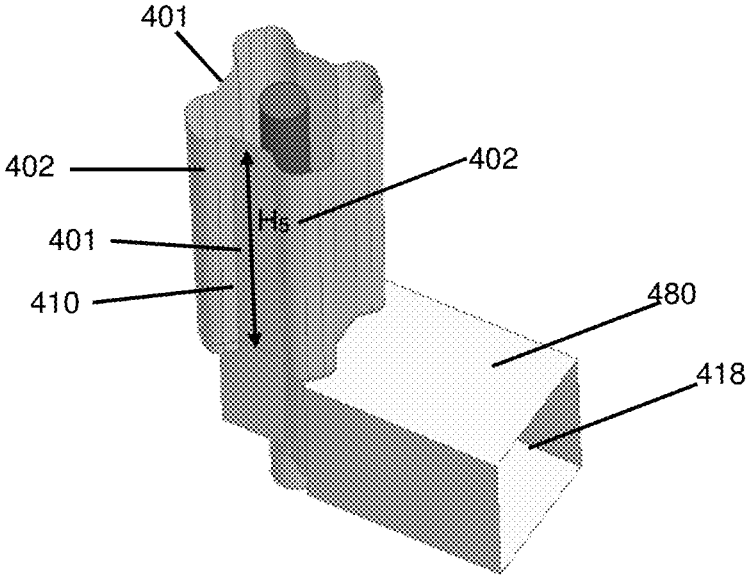
FIG. 4 illustrates an embodiment of a feed comprising an external waveguide having at least one wall comprising a first portion which protrudes inwardly in a plane orthogonal to a longitudinal direction of this external waveguide.

Attention is now drawn to FIG. 4.

According to some embodiments, the first waveguide 107 comprises at least one wall 410 which comprises a first portion 401 which protrudes inwardly towards the second waveguide with respect to a second portion 402 of this wall.

The first portion 401 thus corresponds to an inwardly protruding side or edge of the wall.

Thus, a ridge waveguide 107 is obtained.

In particular, for each plane orthogonal to the longitudinal direction 119 in which the first portion 401 is present (an example of such a plane is the plane of FIGS. 4 and 5), the first portion 401 protrudes inwardly towards the second waveguide with respect to the second portion 402 located in this plane.

In the embodiment of FIG. 4, the first portion 401 is located in the central part of the wall 410, and the second portion 402 corresponds to the parts of the wall which are located on each side of the first portion 401 (the central and side parts are defined in a plane parallel to the plane of the wall). This is however not mandatory.

According to some embodiments, the first portion 401 can extend, in the longitudinal direction 119 of the waveguide structure 105, from the first end 110 of the first waveguide 107 to the second end 115 of the first waveguide 107. In some embodiments, the first portion 401 can extend along the whole height of the first waveguide 107.

Figure 4A:
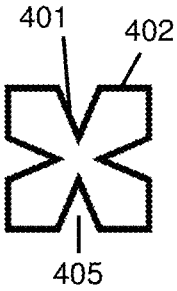
FIGS. 4A to 4E illustrate various non-limitative variants of the first portion of FIG. 4.
Figure 4B:
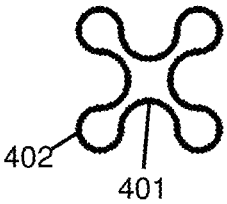
Figure 4C:
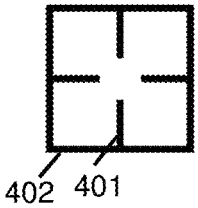
Figure 4D:
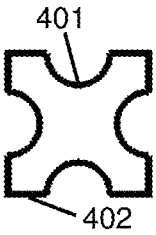
Figure 4E:
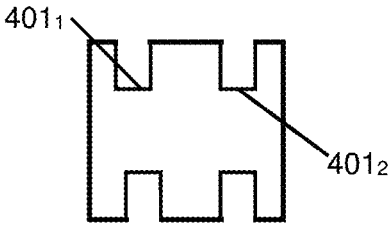

According to some embodiments, at least one wall can comprise at least two distinct first portions 4011, 4012 protruding inwardly, separated by a second portion which does not protrude inwardly (see FIG. 4E, in which this configuration was illustrated for two opposite walls).

According to some embodiments, the first portion 401 can extend, in the longitudinal direction 119 of the waveguide structure 105 (the "top" side or "up" side corresponds to the side of the dual band port and the "bottom" or down" side corresponds to the side of the low and high band ports—this is only a matter of definition), from the top part (e.g. top wall 480) of the structure 418 (corresponding to structure 118), or from the interface (see reference 180 in FIG. 2A) between the first section 112 and the second section 113 (if these sections are present in the first waveguide 107), along a height $H_5$.

According to some embodiments, $H_5$ is greater or equal to $0.6\ \lambda_1$($\lambda_1$ was defined previously).

According to some embodiments, the first portion 401 is present along at least part or along the whole height of the first section 112 (if this first section 112 is present, see FIGS. 2 and 3 for a description of this first section 112).

According to some embodiments, at least two walls (such as two opposite walls) of the first waveguide 107 each comprise a first portion 401 and a second portion 402 as described above.

According to some embodiments, at least three of the walls of the first waveguide 107 each comprises a first portion 401 and a second portion 402 as described above.

According to some embodiments, each of the four walls of the first waveguide 107 comprises a first portion 401 and a second portion 402 as described above.

The first portion can be manufactured in different ways. According to some embodiments, a cavity is manufactured in the wall. According to some embodiments, the first portion is manufactured by: CNC, 3D printer, molding or extrusion. This is however not limitative.

Various shapes can be used for the first portion.

According to some embodiments, a cross-section of the first portion (e.g. in a plane orthogonal to the longitudinal axis 119) can have one of the following shapes (substantially or approximately):

triangular shape (see FIG. 4A);
rectangular shape (see FIG. 4B);
linear shape (see FIG. 4C),
a portion of a circle (see FIG. 4D), etc.

According to some embodiments, the first waveguide 107 is configured to communicate first electromagnetic radiations (low band radiations) in at least a first, a second and a third electromagnetic mode. The first and second mode correspond to the fundamental TE mode (one for each polarization) and are desired mode. The third mode is a TM mode which is undesired since it can degrade performances.

The third mode cannot be cancelled by decreasing the dimensions of the first waveguide 107, since the second waveguide 108 is present within the first waveguide 107.

The presence of the first portion in at least one wall can help attenuating or cancelling the third electromagnetic mode. Indeed, the third electromagnetic mode may alter the gain and performance of the antenna.

In particular, according to some embodiments, in view of the structure of the first waveguide described above, it is possible to obtain a coupling of −20 dB or less between the first electromagnetic radiations (low band signal) and the third mode.

According to some embodiments, the presence of the first portion 401 does not affect the first and the second electromagnetic modes.

According to some embodiments, a cavity is adjacent to the first portion (see e.g. reference 405 in FIG. 4A, but this can apply to the other configurations as well). As shown, the first portion 401 thus delimits a cavity 405 manufactured in the wall of the first waveguide 107.

Figure 5A:
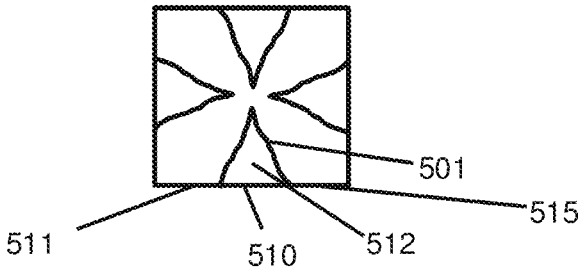
FIGS. 5A and 5B illustrate other non-limitative embodiments of the first portion of FIG. 4.
Figure 5B:
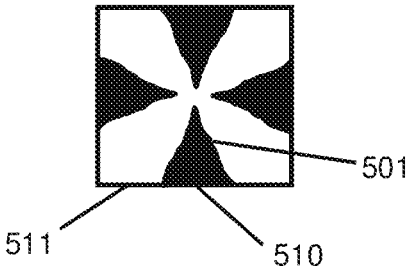

According to other embodiments, the part of the wall of the first waveguide 107, at which the first portion 501 is located, has an external surface 510 which is substantially continuous (that is to say located in the same plane) with the external surface 511 of the second portion (see e.g. the non-limitative example of FIGS. 5A and 5B, in which surface 510 and surface 511 are in line and constitute a single common external surface of the wall).

According to some embodiments, the first portion 501 can be a portion which is filled with material (see FIG. 5B) or which delimits a cavity 512 together with the wall 515 of the first waveguide 107 (see FIG. 5A).

The embodiments described with reference to FIGS. 4 and 5 can be combined with any of the embodiments described with reference to FIGS. 1 to 3, but this is not mandatory.

For example, FIG. 2A shows an embodiment in which the waveguide structure 105 comprises both:

a first waveguide 107 which has at least one wall having first and second portions as described with reference to FIGS. 4 and 5, and
a first waveguide 107 which comprises a first section 112, a second section 113 (as defined above), and a second protrusion 201 as described with reference to FIGS. 1 to 3.

In this embodiment, the first and second portions can be present in at least part of the first section 112 of the first waveguide 107, and the protruding wall 152 of the second section 113 of the first waveguide 107 can protrude more (inwardly, along the lateral direction 109) than the first portion 401 (and a fortiori more than the second portion 402) of the wall of the first section 112. This is visible e.g. in FIG. 2A. This is also visible in FIG. 1, in which a protruding wall of the second section is visible at the second end 115, and protrudes inwardly along the lateral direction 109 with respect to a first portion of a wall of the first section.

According to some particular embodiments, the first portion 401 and the second portion 402 can be present both in the first section 112 and in the second section 113: in this case, in the second section 113, at least one first wall of the first waveguide (such as the protruding wall 152) protrudes inwardly more than the other walls of the first section, and at least one second wall (e.g. a second wall of the first waveguide opposite to the first wall) of the second section comprises a first portion 401 and a second portion 402.

This is however not mandatory and according to some embodiments, the feed can be manufactured to be in compliance only with the embodiments of FIGS. 1 to 3, or only with the embodiments of FIGS. 4 and 5.

Other combinations of these technical features can be performed.

A method of operation of the antenna 100 described with reference to FIGS. 4 and 5 can comprise at least one of:

transmitting:
first electromagnetic radiations from the low band port to the first waveguide and then to the reflector which reflects the first electromagnetic radiations, such as towards the dish (see reference 700 in FIG. 7A), and
second electromagnetic radiations from the high band port to the second waveguide, and then to the reflector which reflects the second electromagnetic radiations, such as towards the dish (see reference 710 in FIG. 7A);
receiving:
first electromagnetic radiations and second electromagnetic radiations by the dish which reflects them towards the feed (see reference 750 in FIG. 7B),
communicating the first electromagnetic radiations through the first waveguide towards the low band port (see reference 760 in FIG. 7B), and
communicating the second electromagnetic radiations through the second waveguide towards the high band port (see reference 770 in FIG. 7B), wherein at least one of the walls of the first waveguide comprises a first portion and a second portion (see reference 730 in FIG. 7A and reference 790 in FIG. 7B), wherein:

the first portion extends, in said longitudinal direction, along a height of at least 0.6 $\lambda_1$, wherein $\lambda_1$ is a central wavelength of the first electromagnetic radiations, and
for each plane orthogonal to the longitudinal direction 119 in which the first portion is present, the first portion of said wall located in said plane protrudes inwardly towards the second waveguide with respect to the second portion of said wall located in said plane.

Figure 6A:
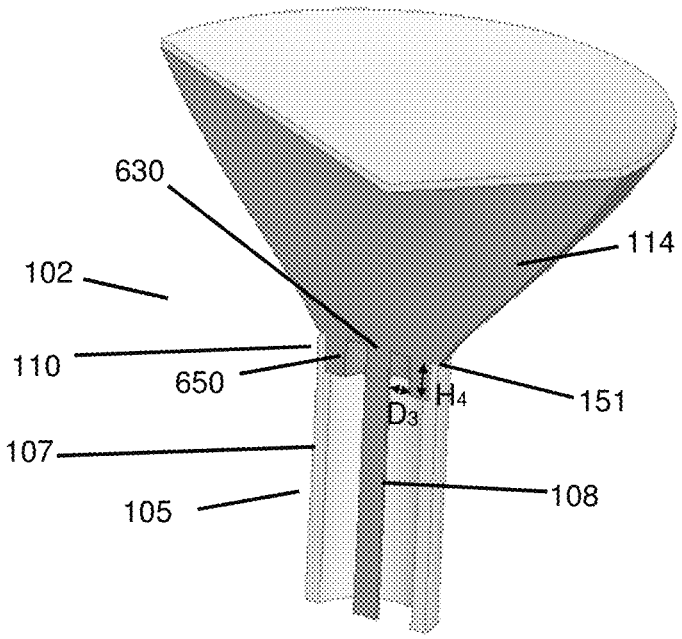
FIG. 6A illustrates an embodiment of a feed comprising an impedance transformer.

Attention is now drawn to FIG. 6A.

According to some embodiments, the feed 102 can comprise an impedance transformer. The feed 102 can have a structure similar to any of the embodiments described above with reference to FIGS. 1 to 5, and thus is not described again.

According to some embodiments, this impedance transformer is a quarter-wave transformer 650.

According to some embodiments, the quarter-wave transformer 650 can be located at an interface 151 between a first end 110 of the waveguide structure 105 and a reflector 114.

As mentioned above, the interface 651 corresponds to a dual band port 630, at which both the first and second electromagnetic radiations can be received or transmitted.

Figure 6B:
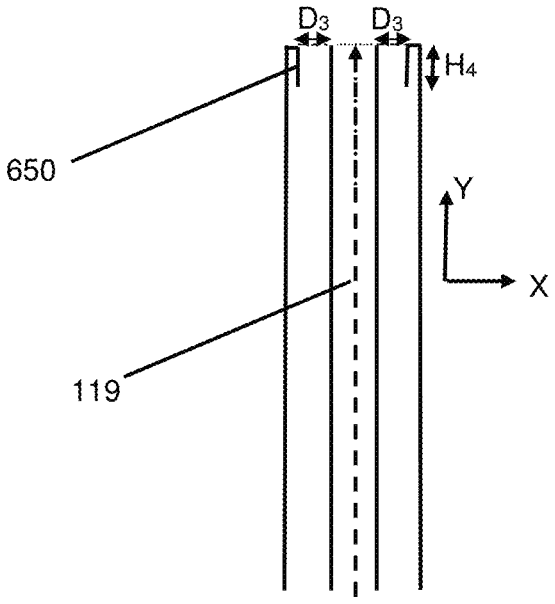
FIG. 6B illustrates a cross-sectional view of the feed of FIG. 6A.

According to some embodiments, and as shown in FIG. 6B, the quarter-wave transformer 650 has a height $H_4$ (measured along the longitudinal axis 119 of the waveguide structure 105) which is substantially equal to $\lambda_1/4$, wherein $\lambda_1$ is the central wavelength of the first electromagnetic radiations.

According to some embodiments, the quarter-wave transformer 650 has an impedance which is a geometric average of the impedance of the first waveguide 107 and of the impedance of the dielectric material of the reflector 114. This can help reducing the return loss.

According to some embodiments, the quarter-wave transformer 650 can in particular reduce the return loss of the first electromagnetic radiations, since a return loss can be in particular present at the interface between the first waveguide 107 and the reflector 114 (that is to say at the dual band port 130).

According to some embodiments, the distance $D_3$ between the quarter-wave transformer 650 and the second waveguide 108 (that is to say the external surface of the walls of the second waveguide 108), measured along a lateral axis 109 (see e.g. axis "X" in FIG. 6B) orthogonal to the longitudinal axis 119 of waveguide structure 105, is such that $D_3>(\lambda_2/4)$, wherein $\lambda_2$ is a maximal wavelength of the second electromagnetic radiations.

According to some embodiments, distance $D_3$ ensures that quarter-wave transformer 650 does not disturb the second electromagnetic radiations (high band signal).

Figure 6C:
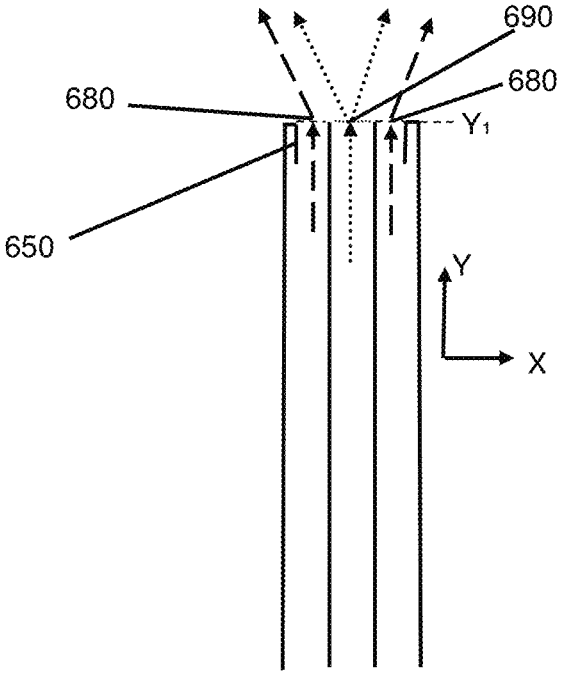
FIG. 6C illustrates examples of positions of phase centers of electromagnetic signals transmitted in the feed of FIGS. 6A and 6B.

Attention is drawn to FIG. 6C.

When electromagnetic radiations are located inside a waveguide (in this case, the first electromagnetic radiations are located within the first waveguide 107 and the second electromagnetic radiations are located within the second waveguide 108), the radiations are constrained to propagate mainly in one direction (which is generally a straight direction, along the longitudinal axis 119 of the waveguide structure 105).

The phase center is generally defined as the position at which the electromagnetic radiations get out of the respective waveguides, and start to scatter to different directions (including directions which are different from the direction of propagation within the respective waveguides).

According to some embodiments, the presence of the quarter wave transformer 650 does not modify a phase center of the second electromagnetic radiations. In particular, according to some embodiments, a phase center 680 of the first electromagnetic radiations and a phase center 690 of the second electromagnetic radiations have the same position (measured along an axis Y which is parallel to the longitudinal axis 119 of the waveguide structure 105), or these positions match each other according to a matching criterion (that is to say that the difference between the two positions measured along this axis is below a threshold). This substantially identical position is illustrated by position "$Y_1$" in FIG. 6C.

This may be obtained in particular due to the fact that the quarter-wave transformer 650 is located at a minimal distance $D_3$ from the second waveguide 108.

The matching of the phase centers improves performances of the antenna at the first and second frequency ranges.

In some embodiments, the phase center 680 of the first electromagnetic radiations and the phase center 690 of the second electromagnetic radiations are both located substantially at the interface 151 between the waveguide structure 105 and the reflector 114.

Figure 6D:
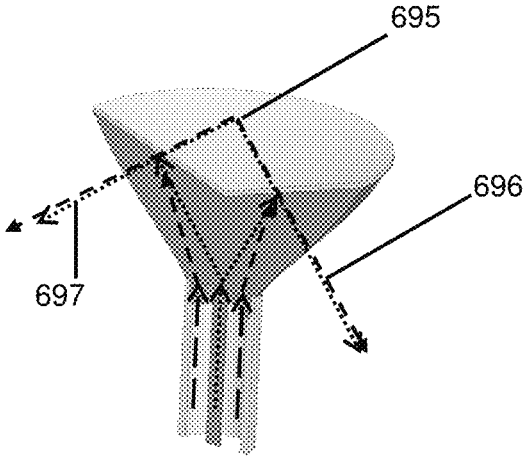
FIG. 6D illustrates a possible transmission of electromagnetic signals using the feed of FIGS. 6A to 6C.

Since the position of the phase center of the first electromagnetic radiations and the position of the phase center of the second electromagnetic radiations match along axis "Y", the reflector 114 is able to reflect the first electromagnetic radiations (see arrows 696 in FIG. 6D) and the second electromagnetic radiations (see arrows 697 in FIG. 6D) as if they came from a common point 695. The common point 695 is generally located at the focal point of the dish. The dish will thus receive both the first electromagnetic radiations and the second electromagnetic radiations from this common point 695, thus improving performance of the antenna.

A method of operation (see FIGS. 7A and 7B) of the antenna 100 can thus comprise:

- transmitting:
  - first electromagnetic radiations from the low band port to a second end of the first waveguide (this first waveguide can comprise in some embodiments a first section and a second section and/or at least one second protrusion—as described above in FIGS. 2 and 3), then to the quarter-wave transformer, and then to the reflector which reflects the first electromagnetic radiations toward the dish (see references 700 and 740 in FIG. 7A), and
  - second electromagnetic radiations from the high band port to the second waveguide, and to the reflector which reflects the second electromagnetic radiations toward the dish (see reference 710 in FIG. 7A-700 and 710 can be performed simultaneously),
- receiving:
  - first electromagnetic radiations and second electromagnetic radiations by the dish which reflects them towards the feed (see reference 750 in FIG. 7B),
  - communicating the first electromagnetic radiations through the quarter-wave transformer, passing the first electromagnetic radiations from a first end of the first waveguide to a second end of the first waveguide (this first waveguide can comprise in some embodiments a first section and a second section and/or at least one second protrusion—as described above in FIGS. 2 and 3), and then communicating the first electromagnetic radiations towards the low band port (see references 760 and 795 in FIG. 7B), and
  - communicating the second electromagnetic radiations through the second waveguide towards the high band port (see reference 770 in FIG. 7B-760 and 770 can be performed simultaneously).

The features described with reference to FIGS. 6A to 6D can be combined with any of the embodiments described above, but this is not mandatory.

In some embodiments, the feed can comprise at least one of the following features, in any combination:

- a first section and a second section and/or at least one second protrusion, as described with respect to FIGS. 1 to 3;
- at least one wall comprising an inwardly protruding first portion (with respect to another second portion of the wall), as described with respect to FIGS. 3 and 4;
- an impedance transformer as described with respect to FIGS. 6A to 6D.

It is to be noted that the various features described in the various embodiments may be combined according to all possible technical combinations.

It is to be understood that the invention is not limited in its application to the details set forth in the description contained herein or illustrated in the drawings. The invention is capable of other embodiments and of being practiced and carried out in various ways. Hence, it is to be understood that the phraseology and terminology employed herein are for the purpose of description and should not be regarded as limiting. As such, those skilled in the art will appreciate that the conception upon which this disclosure is based may readily be utilized as a basis for designing other structures, methods, and systems for carrying out the several purposes of the presently disclosed subject matter.

Those skilled in the art will readily appreciate that various modifications and changes can be applied to the embodiments of the invention as hereinbefore described without departing from its scope, defined in and by the appended claims.

The invention claimed is:

1. A feed for a dual-band antenna, comprising a waveguide structure comprising:

a first waveguide configured to communicate first electromagnetic radiations falling in a first frequency range, wherein the first waveguide extends along a longitudinal direction, and a second dielectric waveguide located within said first waveguide, said second waveguide being configured to communicate second electromagnetic radiations, said second electromagnetic radiations falling in a second frequency range, wherein the second frequency range is higher than the first frequency range, said waveguide structure having a first end whose extremity is configured to pass both first and second electromagnetic radiations, a second end connected to:

a low band port configured to pass said first electromagnetic radiations, and a high band port configured to pass said second electromagnetic radiations, wherein the first waveguide comprises:

a first section extending from said first end along said longitudinal direction, and a second section extending along said longitudinal direction until said second end, wherein a minimal distance between an internal surface of walls of the first section of said first waveguide and an external surface of walls of the second dielectric waveguide is $D_{11}$ along a lateral direction orthogonal to said longitudinal direction, and wherein a maximal distance between an internal surface of at least one first wall of the second section of the first waveguide and an external surface of a wall of the second dielectric waveguide facing said first wall is $D_{12}$ along said lateral direction, wherein $D_{12}<D_{11}$, wherein the waveguide structure further comprises a protrusion located at said second end, wherein at least one of (i) and (ii) is met:

(i) a minimal distance between the surface of said at least one first wall of the second section of the first waveguide and an external surface of a wall of the second dielectric waveguide facing said first wall is D13 along said lateral direction, wherein $0.25*\lambda2\leq D13$, wherein $\lambda2$ is a maximal wavelength of the second electromagnetic radiations, and (ii) the protrusion comprises a portion extending from said at least one first wall towards the low band port along a distance D2, wherein D2 is less or equal to $\lambda1$, wherein $\lambda1$ is a central wavelength of the first electromagnetic radiations.

2. The feed of claim 1, wherein the protrusion protrudes in a direction substantially parallel to the longitudinal direction and constitutes at least part of a floor of the second end of said waveguide structure.

3. The feed of claim 1, wherein the protrusion comprises an opening in which an extremity of the second waveguide is inserted.

4. The feed of claim 1, wherein the protrusion comprises one or more steps.

5. The feed of claim 1, wherein the protrusion and said first wall are orthogonal.

6. The feed of claim 1, wherein at least one of the walls of the first waveguide comprises a first portion and a second portion, wherein the first portion extends, in said longitudinal direction, along a height of at least $0.6\lambda_1$, wherein $\lambda_1$ is a central wavelength of the first electromagnetic radiations, and for each plane orthogonal to the longitudinal direction in which the first portion is present, the first portion of said wall located in said plane protrudes inwardly towards the second waveguide with respect to the second portion of said wall located in said plane.

7. The feed of claim 1, wherein the feed comprises a quarter-wave transformer, located at an interface between said first end of said waveguide structure and a reflector of the feed, wherein a distance $D_3$ between the quarter-wave transformer and the second waveguide is such that $D_{3>}(\lambda_2/4)$, wherein $\lambda_2$ is a maximal wavelength of the second electromagnetic radiations.

8. A feed for a dual-band antenna, comprising a waveguide structure comprising:

a first waveguide configured to communicate first electromagnetic radiations falling in a first frequency range, wherein the first waveguide extends along a longitudinal direction, and a second dielectric waveguide located within said first waveguide, said second waveguide being configured to communicate second electromagnetic radiations, said second electromagnetic radiations falling in a second frequency range, wherein the second frequency range is higher than the first frequency range, said waveguide structure having a first end whose extremity is configured to pass both first and second electromagnetic radiations, a second end connected to:

a low band port configured to pass said first electromagnetic radiations, and a high band port configured to pass said second electromagnetic radiations, wherein the first waveguide comprises walls, wherein at least one of said walls comprises a first portion and a second portion, wherein:

the first portion extends, in said longitudinal direction, along a height of at least $0.6\lambda_1$, wherein $\lambda_1$ is a central wavelength of the first electromagnetic radiations, and for each plane orthogonal to the longitudinal direction in which the first portion is present, the first portion of said wall located in said plane protrudes inwardly towards the second waveguide with respect to the second portion of said wall located in said plane.

9. The feed of claim 8, wherein:

said first portion extends along said height from a top wall of a structure of the low band port which is connected to the first waveguide, or the first waveguide comprises a first section extending from said first end along said longitudinal direction, and a second section extending along said longitudinal direction until said second end, wherein a minimal distance between an internal surface of walls of the first section of said first waveguide and an external surface of walls of the second dielectric waveguide is $D_{11}$ along a lateral direction orthogonal to said longitudinal direction, wherein a maximal distance between an internal surface of at least one first wall of the second section of the first waveguide and an external surface of a wall of the second dielectric waveguide facing said first wall is $D_{12}$ along said lateral direction, wherein $D_{12}<D_{11}$, wherein said first portion extends along said height from an interface between said first section and said second section.

10. The feed of claim 8, wherein each of at least two walls of said first waveguide, or each of at least three walls of said first waveguide, or each of four walls of said first waveguide comprises a first portion and a second portion, wherein:

the first portion extends, in said longitudinal direction, along a height of at least $0.6\lambda_1$, wherein $\lambda_1$ is a central wavelength of the first electromagnetic radiations, and for each plane orthogonal to the longitudinal direction in which the first portion is present, the first portion of said wall located in said plane protrudes inwardly towards the second waveguide with respect to the second portion of said wall located in said plane.

11. The feed of claim 8, wherein said first portion delimits a cavity manufactured in said wall.

12. The feed of claim 8, wherein a shape of a cross-section of said first portion in said plane is one of:

a rectangle, a triangle, a portion of a circle, and a line.

13. The feed of claim 8, wherein at least one of conditions (i) and (ii) is met:

(i) the first waveguide comprises a first section extending from said first end along said longitudinal direction, and a second section extending along said longitudinal direction until said second end, wherein a minimal distance between an internal surface of walls of the first section of said first waveguide and an external surface of walls of the second dielectric waveguide is $D_{11}$ along a lateral direction orthogonal to said longitudinal direction, and wherein a maximal distance between an internal surface of at least one first wall of the second section of the first waveguide and an external surface of a wall of the second dielectric waveguide facing said first wall is $D_{12}$ along said lateral direction, wherein $D_{12}<D_{11}$, wherein the waveguide structure further comprises a protrusion located at said second end;

(ii) the feed comprises a quarter-wave transformer, located at an interface between said first end of said waveguide structure and a reflector of the feed, wherein a distance $D_3$ between the quarter-wave transformer and the second waveguide is such that $D_3>(\lambda_2/4)$, wherein $\lambda_2$ is a maximal wavelength of the second electromagnetic radiations.

14. A feed for a dual-band antenna, comprising a waveguide structure comprising:

a first waveguide configured to communicate first electromagnetic radiations falling in a first frequency range, and a second dielectric waveguide located within said first waveguide, said second waveguide being configured to communicate second electromagnetic radiations, said second electromagnetic radiations falling in a second frequency range, wherein the second frequency range is higher than the first frequency range, said waveguide structure having a first end whose extremity is configured to pass both first and second electromagnetic radiations, a second end connected to:

a low band port configured to pass said first electromagnetic radiations, and a high band port configured to pass said second electromagnetic radiations, a quarter-wave transformer, located at an interface between said first end of said waveguide structure and a reflector of the feed, wherein a distance $D_3$ between the quarter-wave transformer and the second waveguide is such that $D_3>(\lambda_2/4)$, wherein $\lambda_2$ is a maximal wavelength of the second electromagnetic radiations.

15. The feed of claim 14, wherein a position of a phase center of the first electromagnetic radiations and a position of a phase center of the second electromagnetic radiations substantially match along at least one axis.

16. The feed of claim 14, wherein a height H4 of the quarter-wave transformer is equal to $\lambda_1/4$.

17. The feed of claim 14, wherein at least one of conditions (i) and (ii) is met:

(i) the first waveguide comprises a first section extending from said first end along said longitudinal direction, and a second section extending along said longitudinal direction until said second end, wherein a minimal distance between an internal surface of walls of the first section of said first waveguide and an external surface of walls of the second dielectric waveguide is $D_{11}$ along a lateral direction orthogonal to said longitudinal direction, and wherein a maximal distance between a surface of at least one first wall of the second section of the first waveguide and an external surface of a wall of the second dielectric waveguide facing said first wall is $D_{12}$ along said lateral direction, wherein $D_{12}<D_{11}$, wherein the waveguide structure further comprises a protrusion located at said second end; and (ii) at least one of the walls of the first waveguide comprises a first portion and a second portion, wherein the first portion extends, in said longitudinal direction, along a height of at least $0.6\lambda_1$, wherein $\lambda_1$ is a central wavelength of the first electromagnetic radiations, and for each plane orthogonal to the longitudinal direction in which the first portion is present, the first portion of said wall located in said plane protrudes inwardly towards the second waveguide with respect to the second portion of said wall located in said plane.

18. A dual-band antenna, comprising a feed in accordance with claim 1, and a dish, configured to reflect at least first and second electromagnetic radiations towards the feed or transmitted by the feed.

* * * * *